US009044848B2

(12) United States Patent
Iio

(10) Patent No.: US 9,044,848 B2
(45) Date of Patent: Jun. 2, 2015

(54) IMPACT TOOL HAVING A VIBRATION REDUCING MEMBER

(75) Inventor: Takayoshi Iio, Anjo (JP)

(73) Assignee: MAKITA CORPORATION, Anjo (JP)

( * ) Notice: Subject to any disclaimer, the term of this patent is extended or adjusted under 35 U.S.C. 154(b) by 811 days.

(21) Appl. No.: 13/318,676

(22) PCT Filed: May 6, 2010

(86) PCT No.: PCT/JP2010/057767

§ 371 (c)(1),
(2), (4) Date: Jan. 13, 2012

(87) PCT Pub. No.: WO2010/128665

PCT Pub. Date: Nov. 11, 2010

(65) Prior Publication Data

US 2012/0118598 A1 May 17, 2012

(30) Foreign Application Priority Data

May 8, 2009 (JP) ..... 2009-113992

(51) Int. Cl.
*B25D 17/24* (2006.01)
*B25D 16/00* (2006.01)

(52) U.S. Cl.
CPC ..... *B25D 17/24* (2013.01); *B25D 2211/003* (2013.01); *B25D 2211/061* (2013.01); *B25D 2217/0088* (2013.01); *B25D 2217/0092* (2013.01)

(58) Field of Classification Search
USPC ..... 173/162.1, 109, 210
See application file for complete search history.

(56) References Cited

U.S. PATENT DOCUMENTS

2008/0029282 A1 2/2008 Ikuta
2008/0047723 A1* 2/2008 Kamegai et al. ..... 173/109

(Continued)

FOREIGN PATENT DOCUMENTS

CN 101130241 A 2/2008
EP 1 464 449 A2 10/2004

(Continued)

OTHER PUBLICATIONS

Nov. 9, 2011 International Preliminary Report of Patentability issued in International Application No. PCT/JP2010/057767 (with translation).

(Continued)

*Primary Examiner* — Thanh Truong
*Assistant Examiner* — Praachi M Pathak
(74) *Attorney, Agent, or Firm* — Oliff PLC

(57) ABSTRACT

An impact tool includes a motor, a rotating shaft rotationally driven by the motor, a swinging member that swings in an axial direction of a tool bit by rotation of the rotating shaft, a tool driving mechanism connected to an end region of the swinging member in a direction transverse to the axis of the rotating shaft. The tool driving mechanism is moved rectilinearly in the axial direction of the tool bit by swinging movement of the swinging member thereby rectilinearly driving the tool bit. A vibration reducing member reduces vibration caused in the axial direction of the tool bit during operation of the tool bit. The vibration reducing member is disposed on an opposite side of a rectilinear working axis of the tool bit from the rotating shaft and connected to a connecting part between the swinging member and the tool driving mechanism so as to be driven.

7 Claims, 4 Drawing Sheets

(56) References Cited

U.S. PATENT DOCUMENTS

| | | | |
|---|---|---|---|
| 2008/0308287 | A1 | 12/2008 | Sugiyama et al. |
| 2009/0025949 | A1 | 1/2009 | Aoki |
| 2010/0270046 | A1 | 10/2010 | Schlesak et al. |

FOREIGN PATENT DOCUMENTS

| | | | |
|---|---|---|---|
| EP | 1 736 283 | A2 | 12/2006 |
| EP | 1 892 062 | A2 | 2/2008 |
| GB | 2413612 | A | 11/2005 |
| JP | A-2008-307655 | | 12/2008 |
| JP | A-2009-045732 | | 3/2009 |
| WO | WO 2005/105386 | A1 | 11/2005 |
| WO | WO 2009/077241 | A1 | 6/2009 |

OTHER PUBLICATIONS

International Search Report issued in International Patent Application No. PCT/JP2010/057767 dated Aug. 3, 2010.

Chinese Office Action issued in Chinese Patent Application No. 201080020379.2 on Sep. 29, 2013.

Nov. 20, 2013 Extended European Search Report issued in European Patent Application No. 10772183.9.

* cited by examiner

IMPACT TOOL HAVING A VIBRATION REDUCING MEMBER

FIELD OF THE INVENTION

The invention relates to a vibration reducing technique of an impact tool which rectilinearly drives a tool bit in an axial direction of the tool bit via a swinging member.

BACKGROUND OF THE INVENTION

WO 2005/105386 discloses an impact tool in the form of an electric hammer drill having a vibration reducing mechanism. In this known electric hammer drill, a dynamic vibration reducer is provided as a means for reducing vibration caused by hammering operation in the axial direction of a hammer bit, and a weight of the dynamic vibration reducer is forcibly driven by utilizing swinging movement of a swinging member in order to reduce vibration caused during hammering operation.

With the above-described construction, regardless of magnitude of vibration acting upon the impact tool, the dynamic vibration reducer can be steadily operated. In this known impact tool, however, further improvement is required in vibration reducing performance.

SUMMARY OF THE INVENTION

Problems to be Solved by the Invention

Accordingly, it is an object of the present invention to provide a technique for further improving vibration reducing performance, in an impact tool that rectilinearly drives a tool bit in an axial direction of the tool bit via a swinging member.

Means for Solving the Problems

In order to solve the above-described problem, according to a representative embodiment according to the invention, an impact tool which performs a predetermined operation on a workpiece by rectilinear movement of a tool bit in an axial direction of the tool bit includes a motor, a rotating shaft, a swinging member, a tool driving mechanism and a vibration reducing member. The rotating shaft is disposed parallel to the axial direction of the tool bit and rotationally driven by the motor. The swinging member swings in the axial direction of the tool bit by rotation of the rotating shaft. The tool driving mechanism is connected to an end region of the swinging member in a direction transverse to the axis of the rotating shaft, and is caused to rectilinearly move in the axial direction of the tool bit by swinging movement of the swinging member, thereby rectilinearly driving the tool bit. The vibration reducing member serves to reduce vibration caused in the axial direction of the tool bit during operation of the tool bit.

Further, the "impact tool" according to the invention represents an electric hammer which performs a hammering operation by rectilinear striking movement of a hammer bit, and an electric hammer drill which performs a hammer drill operation by rectilinear striking movement and rotation of a hammer bit in the circumferential direction. The manner of "swinging in the axial direction of the tool bit by rotation of the rotating shaft" in this invention typically represents the manner in which the swinging member is inclined at a predetermined angle with respect to the axis of the rotating shaft and rotatably supported by the rotating shaft and the swinging member swings in the axial direction of the rotating shaft while rotating with respect to the rotating shaft by rotation of the rotating shaft. It however suitably includes the manner in which the swinging member inclined at a predetermined angle with respect to the axis of the rotating shaft is supported by the rotating shaft and swings in the axial direction of the rotating shaft while rotating together with the rotating shaft. Further, the "vibration reducing member" in this invention typically includes a dynamic vibration reducer and a counter weight.

According to the preferred embodiment of the present invention, the vibration reducing member is disposed on an opposite side of a rectilinear working axis of the tool bit from the rotating shaft, and the vibration reducing member is connected to a connecting part between the swinging member and the tool driving mechanism in such a manner as to be driven. According to the present invention, with the construction in which the vibration reducing member is disposed on an opposite side of a rectilinear working axis of the tool bit from the rotating shaft, the vibration reducing member is located close to a rectilinear working axis of the tool bit, or to the axis of vibration. As a result, the dynamic vibration reducing member performs a vibration reducing function in a position in which the amplitude of vibration is large, so that the vibration reducing performance is further improved.

According to a further embodiment of the impact tool of the present invention, the vibration reducing member comprises a dynamic vibration reducer of a forced vibration type, including a weight which rectilinearly moves in the axial direction of the tool bit under a biasing force of an elastic element, and the dynamic vibration reducer forcibly drives the weight and thereby reduces vibration caused during operation of the tool bit. In this invention, the dynamic vibration reducer is provided as the vibration reducing member and actively drives the weight of the dynamic vibration reducer. Therefore, regardless of magnitude of vibration acting upon the impact tool, the dynamic vibration reducer can be steadily operated. For example, in the case of an operation that the user performs while applying a strong pressing force to the impact tool, even though vibration reduction is highly required, the amount of input of vibration to the dynamic vibration reducer may be reduced so that the dynamic vibration reducer may not be properly operated. In the impact tool according to this invention, even in such an operation, an adequate vibration reducing function can be ensured.

According to a further embodiment of the impact tool of the present invention, the weight is driven by forcibly vibrating an elastic element receiving part for receiving the elastic element, by a movable member which is connected to the connecting part between the swinging member and the tool driving mechanism. With such a construction in which vibration force is mechanically inputted to the elastic element receiving part for receiving the elastic element, the amount of displacement of the elastic element receiving part can be arbitrarily set. Therefore, the weight can perform the vibration reducing function in the most suitable manner according to the magnitude of vibration caused during operation.

According to a further embodiment of the impact tool of the present invention, the swinging member is rotatably supported by the rotating shaft and swings in the axial direction of the tool bit by rotation of the rotating shaft. The impact tool further includes a power transmitting mechanism that transmits rotating power of the rotating shaft to the tool bit, and in drill mode in which the tool bit is caused to perform only rotation in the circumferential direction via the power transmitting mechanism, the biasing force of the elastic element is applied to the swinging member via the elastic element receiving part and the movable member, so that the swinging member is prevented from swinging following rotation of the rotating shaft. In drill mode, sliding friction is caused between the swinging member and the rotating shaft by rotation of the rotating shaft, and by the sliding friction, the swinging member tends to swing following rotation of the rotating shaft. According to this embodiment, the biasing force of the elastic element is applied to counter this sliding friction so that the swinging member is prevented from swinging following rotation of the rotating shaft. Thus, unintentional striking movement of the tool bit can be prevented.

According to this invention, in an impact tool that rectilinearly drives a tool bit in an axial direction of the tool bit via a swinging member, a technique for further improving vibration reducing performance is provided. Other objects, features and advantages of the present invention will be readily understood after reading the following detailed description together with the accompanying drawings and the claims.

DETAILD EXPLANATION OF REPRESENTATIVE EMBODIMENT OF THE INVENTION

Each of the additional features and method steps disclosed above and below may be utilized separately or in conjunction with other features and method steps to provide improved impact tools and devices utilized therein. Representative examples of this invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

Figure 1:
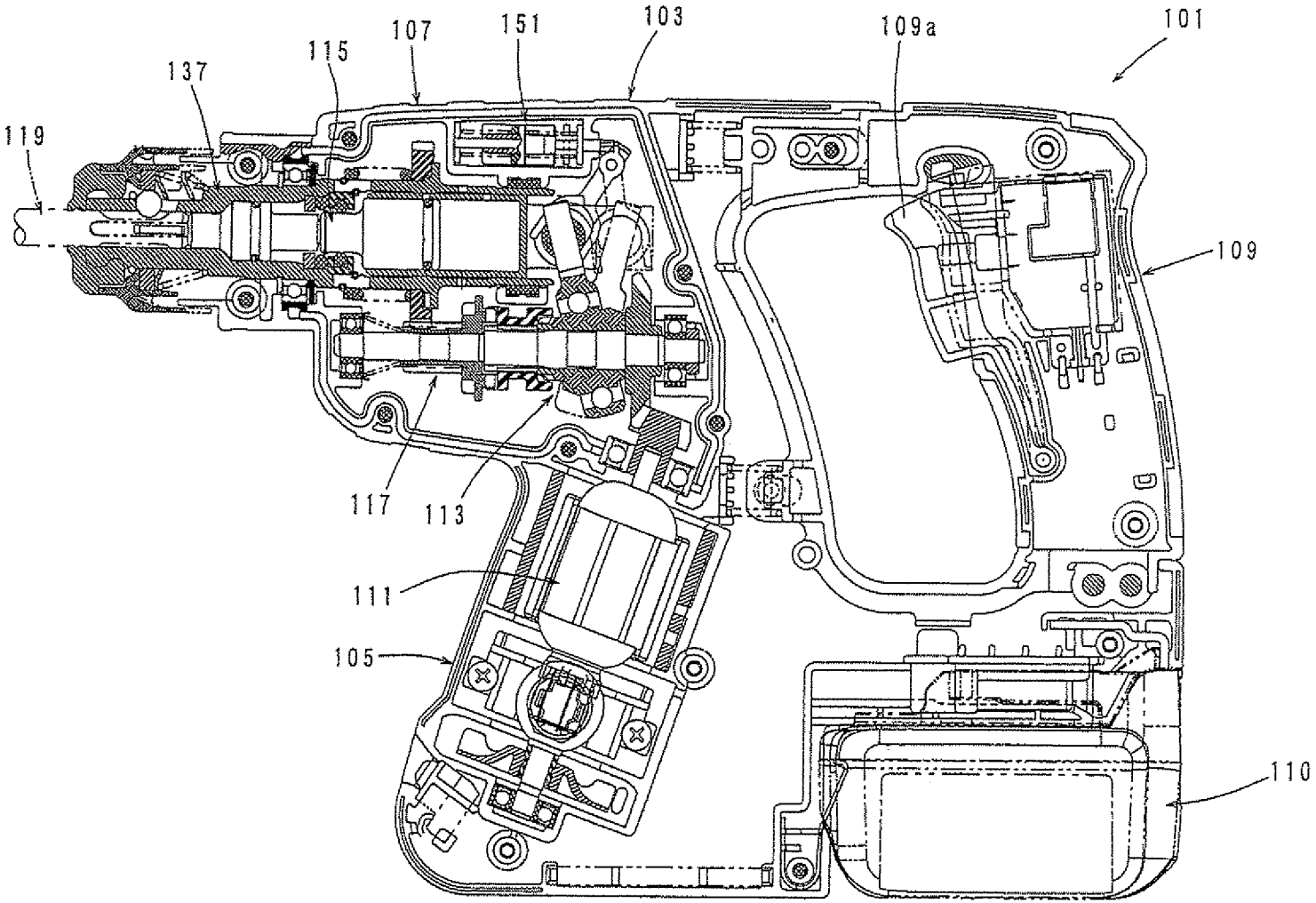
FIG. 1 is a sectional view showing an entire electric hammer drill according to an embodiment of this invention.

An embodiment of the present invention is now described with reference to FIGS. 1 to 5. In this embodiment, a rechargeable electric hammer drill is explained as a representative example of an impact tool. As shown in FIG. 1, the electric hammer drill 101 mainly includes a tool body in the form of a body 103 that forms an outer shell of the hammer drill 101, an elongate hammer bit 119 that is detachably coupled to a hollow tool holder 137 in a front end region (on the left as viewed in FIG. 1) of the body 103 in its longitudinal direction, and a handgrip 109 that is connected to the other end (right end as viewed in FIG. 1) of the body 103 in its longitudinal direction. The hammer bit 119 is a feature that corresponds to the "tool bit" according to the present invention. The hammer bit 119 is held by the tool holder 137 such that it is allowed to reciprocate with respect to the tool holder 137 in its axial direction (in the longitudinal direction of the body 103) and prevented from rotating with respect to the tool holder 137 in its circumferential direction. A grip part of the handgrip 109 extends in a vertical direction transverse to the axial direction of the hammer bit 119, and a rechargeable battery pack 110 from which the driving motor 111 is powered is attached to the lower end of the grip part of the handgrip 109. Further, in this embodiment, for the sake of convenience of explanation, the side of the hammer bit 119 is taken as the front, and the side of the handgrip 109 as the rear.

The body 103 mainly includes a motor housing 105 that houses a driving motor 111, and a gear housing 107 that houses a motion converting mechanism 113, a striking mechanism 115 and a power transmitting mechanism 117. The motion converting mechanism 113, striking mechanism 115 and the power transmitting mechanism 117 are disposed in an upper region within the body 103, and the driving motor 111 is disposed in a lower region within the body 103 such that its axis of rotation is inclined rearward to some extent with respect to the vertical direction transverse to the axial direction of the hammer bit 119. The driving motor 111 is a feature that corresponds to the "motor" according to the present invention. The motion converting mechanism 113 appropriately converts the rotating output of the driving motor 111 into rectilinear motion and then transmits it to the striking mechanism 115. Then, an impact force is generated in the axial direction of the hammer bit 119 (the horizontal direction as viewed in FIG. 1) via the striking mechanism 115. Further, the power transmitting mechanism 117 appropriately reduces the speed of the rotating output of the driving motor 111 and transmits it to the hammer bit 119, so that the hammer bit 119 is caused to rotate in a circumferential direction. The driving motor 111 is driven when a user depresses a trigger 109*a* disposed on the handgrip 109.

Figure 2:
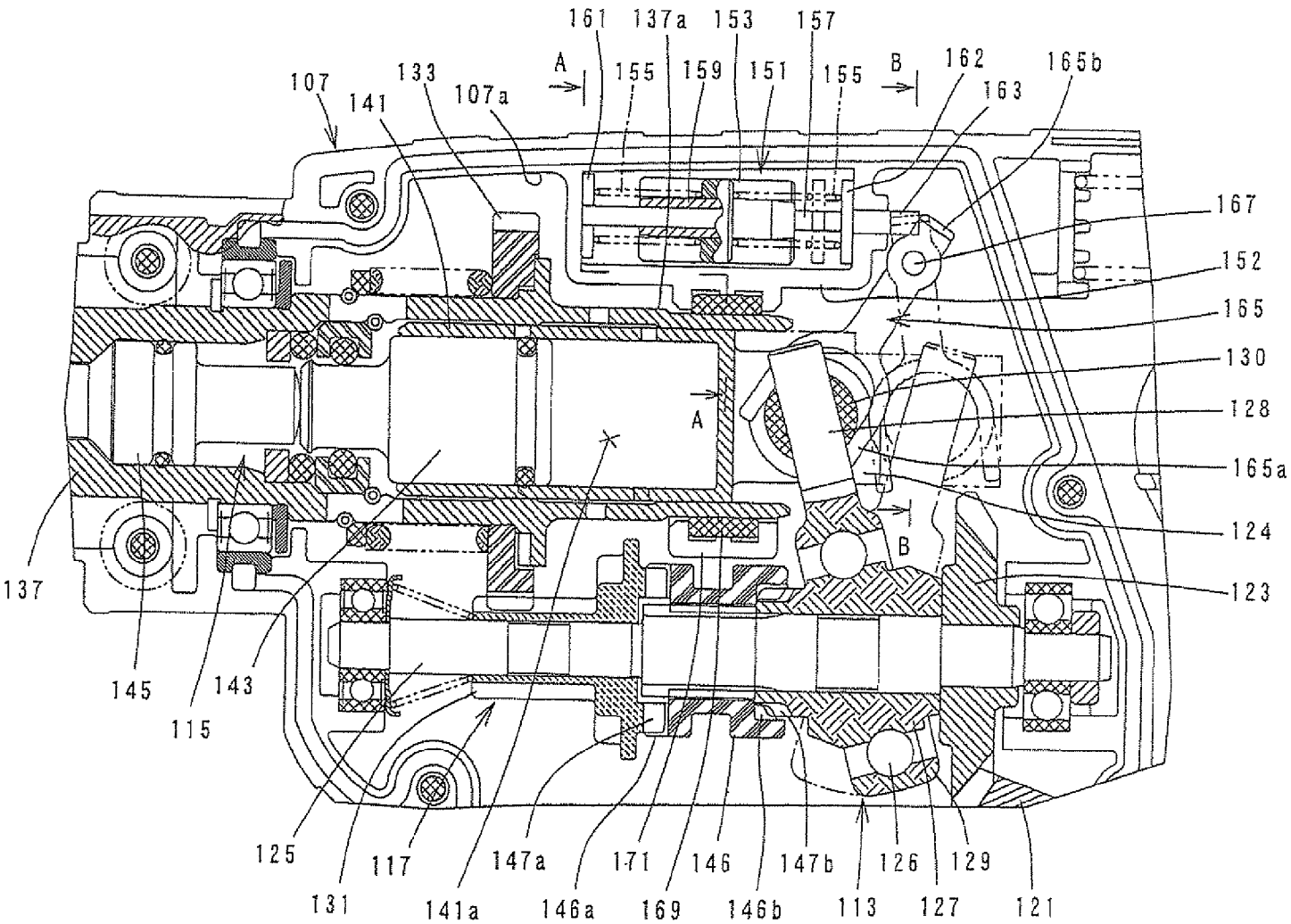
FIG. 2 is an enlarged sectional view showing an essential part of the hammer drill.

As shown in FIG. 2, the motion converting mechanism 113 mainly includes a driving bevel gear 121 which is rotationally driven substantially in a horizontal plane by the driving motor 111 (see FIG. 1), a driven bevel gear 123 which is held in engagement with the driving bevel gear 121 and rotationally driven in a vertical plane, a rotating element 127 which rotates together with the driven bevel gear 123 via an intermediate shaft 125, a swinging ring 129 which is caused to swing in the axial direction of the hammer bit 119 by rotation of the rotating element 127, and a cylindrical piston 141 which is caused to reciprocate by swinging movement of the swinging ring 129. The intermediate shaft 125 and the swinging ring 129 are features that correspond to the "rotating shaft" and the "swinging member", respectively, according to the present invention. The intermediate shaft 125 extends horizontally in the axial direction of the hammer bit 119. The outer periphery of the rotating element 127 fitted onto the intermediate shaft 125 is inclined at a predetermined angle with respect to the axis of the intermediate shaft 125. The swinging ring 129 is rotatably supported on the inclined outer periphery of the rotating element 127 via a bearing 126 and caused to swing in the axial direction of the hammer bit 119 by rotation of the rotating element 127. The rotating element 127 and the swinging ring 129 which is rotatably supported on the rotating element 127 via the bearing 126 form a swinging mechanism.

Further, a swinging rod 128 is formed on an upper end region of the swinging ring 129 and extends upward therefrom, and the swinging rod 128 is connected to an extending part 124 extending from a rear end of the cylindrical piston 141, via a piston joint pin 130. The piston joint pin 130 is a columnar member and is mounted such that it can rotate around its axis extending in a horizontal (transverse) direction transverse to the axial direction of the hammer bit 119 with respect to the extending part 124. The swinging rod 128 extends through the piston joint pin 130 and can slide in the radial direction (transversely) with respect to the piston joint pin 130. The cylindrical piston 141 is slidably disposed within the tool holder 137 and driven by swinging movement (its components in the axial direction of the hammer bit 119) of the swinging ring 129 so as to rectilinearly slide along the bore wall of the tool holder 137.

The striking mechanism 115 mainly includes a striking element in the form of a striker 143 that is slidably disposed within the bore of the piston 141, and an intermediate element in the form of an impact bolt 145 that is slidably disposed within the tool holder 137 and serves to transmit kinetic energy of the striker 143 to the hammer bit 119. The striker 143 is driven via air spring action of an air chamber 141*a* of the piston 141 by sliding movement of the piston 141. The striker 143 then collides with (strikes) the impact bolt 145 which is slidably disposed within the tool holder 137. As a result, a striking force caused by the collision is transmitted to the hammer bit 119 via the impact bolt 145. The cylindrical piston 141, the striker 143 and the impact bolt 145 form the "tool driving mechanism" according to this invention.

The power transmitting mechanism 117 mainly includes a first transmission gear 131 that is caused to rotate in a vertical plane by the driving motor 111 via the driving bevel gear 121 and the intermediate shaft 125, a second transmission gear 133 that is engaged with the first transmission gear 131, and a final shaft in the form of the tool holder 137 that is caused to rotate together with the second transmission gear 133. The rotational driving force of the tool holder 137 is transmitted to the hammer bit 119 held by the tool holder 137. The first transmission gear 131 is fitted onto the intermediate shaft 125 forward (on the hammer bit 119 side) of the swinging ring 129 such that it can move with respect to the intermediate shaft 125 in the axial direction and can rotate together with the intermediate shaft 125 in the circumferential direction. Further, the second transmission gear 133 is always held in engagement with the first transmission gear 131 and fitted onto the tool holder 137 such that it can rotate together with the tool holder 137 on the same axis.

In the hammer drill 101 having the above-described construction, when the driving motor 111 is driven, the driving bevel gear 121 is caused to rotate by the rotating output of the driving motor 111. Then, the rotating element 127 is caused to rotate in a vertical plane via the driven bevel gear 123 that is engaged with the driving bevel gear 121, and the intermediate shaft 125, which in turn causes the swinging ring 129 and the swinging rod 128 to swing in the axial direction of the hammer bit 119. Then the piston 141 is caused to rectilinearly slide by the swinging movement of the swinging rod 128. By the air spring action of the air chamber 141*a* of the piston 141 as a result of this sliding movement of the piston 141, the striker 143 rectilinearly moves within the piston 141 and collides with the impact bolt 145. Thus, the hammer bit 119 performs a hammering movement in the axial direction.

When the first transmission gear 131 is caused to rotate together with the intermediate shaft 125, the tool holder 137 and the hammer bit 119 held by the tool holder 137 rotate together via the second transmission gear 133 which is engaged with the first transmission gear 131. Thus, the hammer bit 119 performs a hammering movement in the axial direction and a drilling movement in the circumferential direction, so that an operation (drilling operation) is performed on the workpiece.

The electric hammer drill 101 can be switched not only to the above-described hammer drill mode in which the hammer bit 119 is caused to perform a hammering movement and a drilling movement in the circumferential direction, but to drill mode in which the hammer bit 119 is caused to perform only a drilling movement and to hammer mode in which the hammer bit 119 is caused to perform only a hammering movement. For this purpose, an operation mode switching clutch is disposed on the intermediate shaft 125.

The operation mode switching clutch mainly includes a clutch cam 146 which is disposed between the rotating element 127 of the motion converting mechanism 113 and the first transmission gear 131 of the power transmitting mechanism 117. The clutch cam 146 is fitted onto the intermediate shaft 125 such that it can move with respect to the intermediate shaft 125 in the axial direction and can rotate together with the intermediate shaft 125 in the circumferential direction. The clutch cam 146 has driving clutch teeth 146*a*, 146*b* formed on its front and rear surfaces. The rotating power of the intermediate shaft 125 is transmitted to the first transmission gear 131 when the front driving clutch teeth 146*a* are engaged with driven clutch teeth 147*a* formed on a rear surface of the first transmission gear 131. This power transmission is interrupted by disengagement of these clutch teeth. Further, the rotating power of the intermediate shaft 125 is transmitted to the rotating element 127 when the rear driving clutch teeth 146*b* are engaged with driven clutch teeth 147*b* formed on a front surface of the rotating element 127. This power transmission is interrupted by disengagement of these clutch teeth. Engagement and disengagement of the clutch cam 146 can be made by operating the operation mode switching member on the body 103, but this technique is well known and therefore its further description is omitted.

A vibration reducing mechanism which serves to reduce impulsive and cyclic vibration caused in the axial direction of the hammer bit 119 during operation of the electric hammer drill 101 is now described with reference to FIGS. 2 to 5. The vibration reducing mechanism according to this embodiment mainly includes a dynamic vibration reducer 151 which is forcibly driven (forcibly vibrated) by the swinging ring 129. The dynamic vibration reducer 151 is a feature that corresponds to the "vibration reducing member" according to the present invention.

When the hammer bit 119 performs a liner hammering movement, vibration is caused in the body 103 in the axial direction of the hammer bit 119. In this embodiment, as shown in FIG. 2, the dynamic vibration reducer 151 is disposed within an internal space between an inner wall 107*a* of the gear housing 107 and a rear outer surface 137*a* of the tool holder 137 and in a region on the opposite side of the axis of the hammer bit 119 (the rectilinear working axis of the hammer bit 119) from the intermediate shaft 125, or more specifically, in a region located behind the second transmission gear 133 fitted on the tool holder 137 and above the tool holder 137. Therefore, the dynamic vibration reducer 151 is located close to the axis of vibration which is caused along the rectilinear working axis of the hammer bit 119 when the hammer bit 119 performs rectilinear hammering movement.

Figure 3:
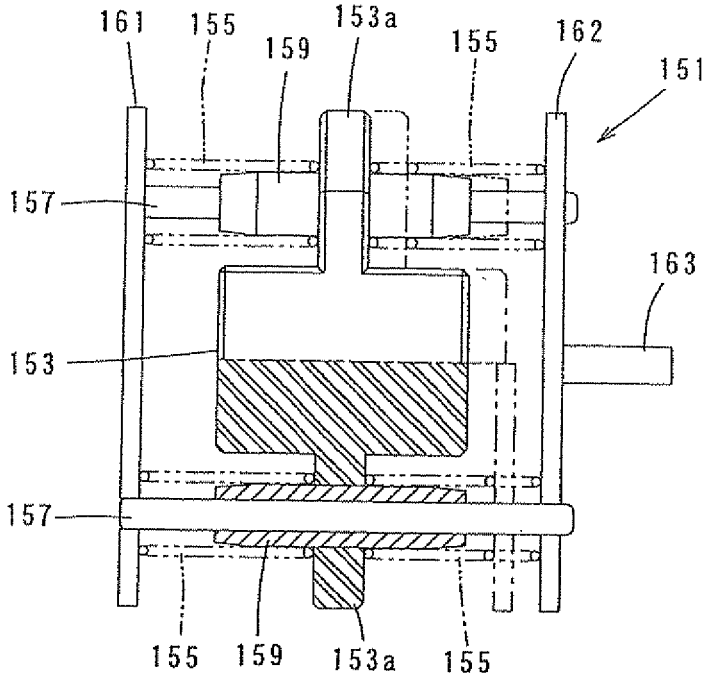
FIG. 3 is a sectional plan view showing a dynamic vibration reducer.
Figure 4:
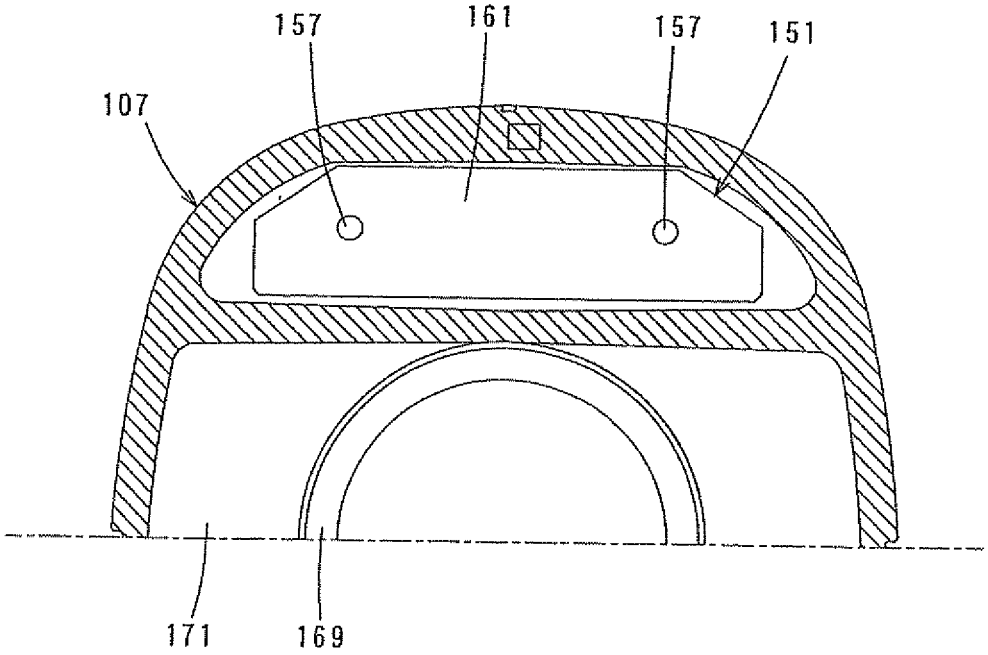
FIG. 4 is a sectional view taken along line A-A in FIG. 2.

As shown in FIGS. 2 and 3, the dynamic vibration reducer 151 mainly includes a box-shaped weight container 152 formed in the internal space of the gear housing 107 and extending in the axial direction of the hammer bit 119, a vibration reducing weight 153 which is disposed within the weight container 152 and can rectilinearly move in the axial direction of the hammer bit 119, and front and rear biasing springs 155 disposed at the front and rear of the weight 153 within the weight container 152. The biasing spring 155 is a feature that corresponds to the "elastic element" according to the present invention. Two guide rods 157 are disposed on the both sides of the weight 153 and extend in parallel in the axial direction of the hammer bit 119. The weight 153 has right and left projections 153*a* extending from its side surfaces, and each of the projections 153*a* is supported by the associated guide rod 157 via a sleeve 159 such that the weight 153 can move with respect to the guide rods 157 in the axial direction of the hammer bit 119. With this construction, stable and smooth rectilinear movement of the weight 153 can be ensured.

The two guide rods 157 are connected at their front ends by a front plate 161 and also connected at their rear ends by a rear plate 162. Biasing springs 155 are elastically disposed between the front plate 161 and the projections 153*a* of the weight 153 and between the rear plate 162 and the projections 153*a*. The front and rear biasing springs 155 apply spring forces to the weight 153 toward each other when the weight 153 moves in the axial direction of the hammer bit 119 within the weight container 152. The front and rear plates 161, 162 are features that correspond to the "elastic element receiving part" according to the present invention. The front plate 161 is fixed to the two guide rods 157 and held pressed against a front wall of the weight container 152 by the biasing forces of the front biasing springs 155. The rear plate 162 is fitted onto the two guide rods 157 such that it can move with respect to the guide rods in their axial direction and pressed toward a rear wall of the weight container 152 by the biasing forces of the rear biasing springs 155.

An operating rod 163 is formed on the rear surface of the rear plate 162 and extends rearward substantially coaxially with the longitudinal axis of the weight 153. The operating rod 163 protrudes to the outside of the weight container 152 (into the internal space of the gear housing 107) through the rear wall of the weight container 152, and its protruding end is connected to the piston joint pin 130 via a joint arm 165.

The joint arm 165 is provided as a member for inputting vibration force by which the weight 153 of the dynamic vibration reducer 151 is actively driven and forcibly vibrated. The joint arm 165 is a feature that corresponds to the "movable member" according to this invention. The joint arm 165 is mounted to the gear housing 107 such that it can swing on a pivot shaft 167 in the fore-and-aft direction (the axial direction of the hammer bit 119). The joint arm 165 has a bifurcated engagement part 165*a* on its one end (lower end), and the engagement part 165*a* is slidably engaged with the piston joint pin 130. Therefore, when the swinging rod 128 of the swinging ring 129 is caused to swing in the fore-and-aft direction and thus the piston joint pin 130 is caused to rectilinearly move in the fore-and-aft direction, the joint arm 165 is caused to swing on the pivot shaft 167 in the fore-and-aft direction. A front surface of the other end of the joint arm 165 (on the opposite side of the pivot shaft 167 from the engagement part 165*a*) is held in contact with the end of the operating rod 163. The front surface of the other end of the joint arm 165 is designed as a pressure part 165*b* for pressing the operating rod 163 forward when the piston joint pin 130 moves rearward. As shown by two-dot chain line in FIG. 2, when the piston joint pin 130 moves rearward, the pressure part 165*b* presses the operating rod 163 forward and drives the weight 153 via the rear plate 162 and the biasing springs 155. Specifically, the joint arm 165 rectilinearly moves the weight 153 via the biasing springs 155 with a phase difference of about 180 degrees with respect to the rectilinear movement of the piston 141 (in a direction opposite to the direction of movement of the piston).

Figure 5:
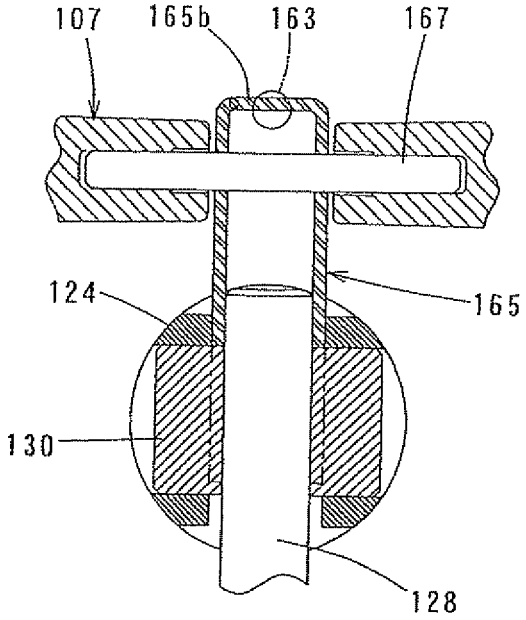
FIG. 5 is a sectional view taken along line B-B in FIG. 2.

The operating rod 163 is disposed on the axis of the swinging rod 128. Therefore, in this embodiment, as shown in FIG. 5, the joint arm 165 is formed by a plate bent into a generally U shape, and a front end surface of the bent portion is held in contact with the end of the operating rod 163, and the right and left flat plate portions are disposed on both sides of the swinging rod 128. With this construction, the joint arm 165 can effectively transmit rectilinear movement of the piston joint pin 130 to the operating rod 163 while avoiding interference with the swinging rod 128. Further, a bearing cover 171 for rotatably supporting a rear end portion of the tool holder 137 is integrally connected to the weight container 152.

In the electric hammer drill 101 having the above-described construction, the dynamic vibration reducer 151 formed in the body 103 performs a vibration reducing function of reducing impulsive and cyclic vibration caused in the axial direction of the hammer bit 119 during operation. Specifically, in this embodiment, when the hammer drill 101 is driven, the joint arm 165 is caused to swing on the pivot shaft 167 in the axial direction of the hammer bit 119 by swinging movement of the swinging ring 129. When the joint arm 165 swings in one direction (forward in this embodiment), the pressure part 165*b* of the joint arm 165 rectilinearly moves the rear plate 162 of the dynamic vibration reducer 151 and presses the biasing springs 155 and thus moves the weight 153 in the direction in which it presses the biasing springs 155. Specifically, the weight 153 can be actively driven and forcibly vibrated. Thus, regardless of magnitude of vibration acting upon the body 103, the dynamic vibration reducer 151 can be steadily operated. For example, in the case of a hammering or hammer drill operation that the user performs while applying a strong pressing force to the hammer drill 101, even though vibration reduction is highly required, the amount of input of vibration to the dynamic vibration reducer 151 may be reduced due to this pressing force and the dynamic vibration reducer 151 may not be properly operated. Even in such an operation, an adequate vibration reducing function can be ensured by actively driving the weight 153.

Particularly, in this embodiment, the dynamic vibration reducer 151 is disposed above the rear region of the tool holder 137, or on the opposite side of the axis of the hammer bit 119 from the intermediate shaft 125. Thus the dynamic vibration reducer 151 is located close to the axis of vibration caused along the rectilinear working axis of the hammer bit 119. As a result, the dynamic vibration reducer 151 performs a vibration reducing function in a position in which the amplitude of vibration is large, so that the vibration reducing performance is further improved.

Further, in this embodiment, the rear plate 162 for receiving the biasing springs 155 which apply biasing forces to the weight 153 is mechanically vibrated by the joint arm 165, and the amount of displacement of the rear plate 162 can be easily adjusted by changing the position of the pivot (the pivot shaft 167) of the joint arm 165. Specifically, the amount of displacement of the rear plate 162 can be freely set such that the weight 153 can perform the vibration reducing function in the most suitable manner according to the magnitude of vibration caused during operation.

When the hammer drill 101 is driven with the operation mode switching clutch cam 146 engaged with the first transmission gear 131 and disengaged from the rotating element 127, or it is driven in drill mode in which the hammer bit 119 performs only drilling movement, the rotating element 127 tends to follow rotation of the intermediate shaft 125 by sliding friction which is caused between the intermediate shaft 125 and the rotating element 127 by rotation of the intermediate shaft 125. Specifically, the rotating element 127 tends to rotate together with the intermediate shaft 125, but at this time, the biasing forces of the biasing springs 155 of the dynamic vibration reducer 151 act as forces of inhibiting the swinging movement of the swinging ring 129 via the operating rod 163 and the joint arm 165, and thus act as forces of inhibiting the rotating element 127 from rotating together with the intermediate shaft 125. Therefore, the biasing forces of the biasing springs 155 are set such that these inhibiting forces become larger than the above-described sliding friction. With this arrangement, during operation in drill mode, the motion converting mechanism 113 can be prevented from being unintentionally operated, so that the hammering movement of the hammer bit 119 can be reliably prevented.

The contour of the gear housing 107, or particularly the contour of a region of the gear housing 107 above the axis of the hammer bit 119, is dimensioned to contain the second transmission gear 133 having the largest diameter of all of the members or parts disposed on the axis of the hammer bit 119. The tool holder 137 having a smaller diameter than the second transmission gear 133 extends rearward of the second transmission gear 133. Therefore, a space defined by the inner wall of the gear housing 107, a rear surface of the second transmission gear 133, and the rear outer surface 137*a* of the tool holder 137 exists as a dead space behind the second transmission gear 133. In this embodiment, the dynamic vibration reducer 151 is disposed by utilizing this dead space. Therefore, the dynamic vibration reducer 151 can be rationally installed without the need to increase the size of the gear housing (the body 103).

In this embodiment, the dynamic vibration reducer 151 is described as being used as the vibration reducing member, but in place of the dynamic vibration reducer 151, a counter weight may be used. Further, in this embodiment, the swinging ring 129 is inclined at a predetermined angle with respect to the axis of the intermediate shaft 125 and rotatably supported by the intermediate shaft 125 via the rotating element 127, and the swinging ring 129 is caused to swing in the axial direction of the intermediate shaft 125 by rotation of the rotating element 127. It may however be constructed such that the swinging ring 129 inclined at a predetermined angle with respect to the axis of the intermediate shaft 125 is supported by the intermediate shaft 125 and caused to swing in the axial direction of the intermediate shaft 125 while rotating together with the intermediate shaft 125.

Further, in this embodiment, the hammer drill is described as being of the type in which the axis of rotation of the driving motor 111 extends in a direction transverse to the axial direction of the hammer bit 119. This invention may however be applied to a hammer drill of the type in which the axis of rotation of the driving motor 111 extends parallel to the axial direction of the hammer bit 119. Further, in this embodiment, the rechargeable hammer drill having the battery-powered driving motor 111 is explained as a representative example of the impact tool, but the present invention may also be applied to an electric hammer drill of the type which is driven by external power supply.

DESCRIPTION OF NUMERALS

101 hammer drill (impact tool)
103 body (tool body)
105 motor housing
107 gear housing
107*a* inner wall
109 handgrip
109*a* trigger
110 battery pack
111 driving motor (motor)
113 motion converting mechanism
115 striking mechanism
117 power transmitting mechanism
119 hammer bit (tool bit)
121 driving bevel gear
123 driven bevel gear
124 extending part
125 intermediate shaft (rotating shaft)
126 bearing
127 rotating element
128 swinging rod
129 swinging ring (swinging member)
130 piston joint pin
131 first transmission gear
133 second transmission gear
137 tool holder
137*a* rear outer surface
141 cylindrical piston (tool driving mechanism)
141*a* air chamber
143 striker (tool driving mechanism)
145 impact bolt (tool driving mechanism)
146 clutch cam
146*a* front driving clutch teeth
146*b* rear driving clutch teeth
147*a* driven clutch teeth of the first transmission gear
147*b* driven clutch teeth of the rotating element
151 dynamic vibration reducer (vibration reducing member)
152 weight container
153 weight
153*a* projection
155 biasing spring
157 guide rod
159 sleeve
161 front plate
162 rear plate
163 operating rod
165 joint arm (movable member)
165*a* engagement part
165*b* pressure part
167 pivot shaft
169 bearing
171 bearing cover

What I claim is:

1. An impact tool, which performs a predetermined operation on a workpiece by rectilinear movement of a tool bit in an axial direction of the tool bit, the impact tool comprising:

a motor, a rotating shaft disposed parallel to the axial direction of the tool bit and configured to be rotationally driven by the motor about an axis, a swinging member extending in a first direction transverse to the axis of the rotating shaft, the swinging member being configured to swing in the axial direction of the tool bit due to rotation of the rotating shaft, a tool driving mechanism connected to an end region of the swinging member, the tool driving mechanism being caused to rectilinearly move in the axial direction of the tool bit by a swinging movement of the swinging member, thereby rectilinearly driving the tool bit, and a vibration reducing member drivably connected to a connecting part between the swinging member and the tool driving mechanism by means of a joint arm that swings on a pivot shaft in the axial direction of the tool bit, the vibration reducing member being configured to reduce vibration in the axial direction of the tool bit caused during operation of the tool bit, wherein:

the vibration reducing member is disposed within a tool body of the impact tool on an opposite side of a rectilinear working axis of the tool bit relative to the rotating shaft, the rectilinear working axis is spaced a first distance from the rotating shaft in the first direction, and the vibration reducing member is spaced a second distance from the rotating shaft in the first direction, the second distance being greater than the first distance.

2. The impact tool as defined in claim 1, wherein the vibration reducing member comprises a dynamic vibration reducer of a forced vibration type, including a weight, which rectilinearly moves in the axial direction of the tool bit under a biasing force of an elastic element, and the dynamic vibration reducer forcibly drives the weight and thereby reduces vibration caused during operation of the tool bit.

3. The impact tool as defined in claim 2, wherein the weight is driven by forcibly vibrating an elastic element receiving part for receiving the elastic element by the joint arm, which is connected to the connecting part between the swinging member and the tool driving mechanism.

4. The impact tool as defined in claim 3, wherein the swinging member is rotatably supported by the rotating shaft and swings in the axial direction of the tool bit by rotation of the rotating shaft, the impact tool further comprising a power transmitting mechanism that transmits rotating power of the rotating shaft to the tool bit, wherein, in a drill mode in which the tool bit is caused to perform only rotation in a circumferential direction via the power transmitting mechanism, the biasing force of the elastic element is applied to the swinging member via the elastic element receiving part and the joint arm, whereby the swinging member is prevented from swinging following rotation of the rotating shaft.

5. The impact tool as defined in claim 3, wherein a first end of the joint arm is engaged with the elastic element receiving part and a second end of the joint arm is engaged with the connecting part between the swinging member and the tool driving mechanism.

6. The impact tool as defined in claim 2, wherein the rectilinear movement of the weight is guided via a plurality of guide rods extending in the axial direction of the tool bit.

7. The impact tool as defined in claim 1, further comprising a power transmitting mechanism that transmits rotating power of the rotating shaft to the tool bit, wherein the power transmitting mechanism includes a gear that rotates on the axis of the tool bit, and a tool holder that rotates together with the gear on the axis of the tool bit and rotates the tool bit, and the vibration reducing member is disposed in a region of an internal space of the tool body which is defined by a rear surface of the gear, a region of an outer surface of the tool holder which is located rearward of the gear, and an inner wall surface of the tool body.

* * * * *